US005655492A

United States Patent [19]

Sattler et al.

[11] Patent Number: 5,655,492

[45] Date of Patent: Aug. 12, 1997

[54] LABYRINTH MANIFOLD

[75] Inventors: Eric R. Sattler, Southgate; Damiano LaRosa, Taylor, both of Mich.

[73] Assignee: BASF Corporation, Mt. Olive, N.J.

[21] Appl. No.: 672,830

[22] Filed: Jun. 28, 1996

[51] Int. Cl.[6] ..... F02M 35/10

[52] U.S. Cl. ..... 123/184.42; 123/184.61

[58] Field of Search ..... 123/184.21, 184.42, 123/184.53, 184.61

[56] References Cited

U.S. PATENT DOCUMENTS

| | | | |
|---|---|---|---|
| 4,301,775 | 11/1981 | Smart et al. | 123/184.61 |
| 4,440,120 | 4/1984 | Butler | 123/184.34 |
| 4,501,235 | 2/1985 | Muller | 123/184.53 |
| 4,643,138 | 2/1987 | Ruf et al. | 123/184.34 |
| 4,664,075 | 5/1987 | Poulos | 123/184.42 |
| 4,669,428 | 6/1987 | Ichida et al. | 123/184.31 |
| 4,726,329 | 2/1988 | Atkin | 123/184.34 |
| 4,907,547 | 3/1990 | Daly | 123/184.53 |
| 4,919,086 | 4/1990 | Shillington | 123/184.42 |
| 5,003,932 | 4/1991 | Duncan | 123/184.34 |
| 5,003,933 | 4/1991 | Rush, II et al. | 123/184.42 |
| 5,005,532 | 4/1991 | Shillington | 123/184.42 |
| 5,016,578 | 5/1991 | Ogawa et al. | 123/184.34 |
| 5,074,257 | 12/1991 | Amano et al. | 123/184.42 |
| 5,127,371 | 7/1992 | Ogawa et al. | 123/184.34 |
| 5,261,375 | 11/1993 | Rush, II et al. | 123/470 |
| 5,273,010 | 12/1993 | Elder | 123/184.61 |
| 5,477,819 | 12/1995 | Kopec | 123/184.61 |
| 5,492,088 | 2/1996 | Ohrnberger | 123/184.34 |
| 5,505,170 | 4/1996 | Cutler | 123/184.34 |

FOREIGN PATENT DOCUMENTS

| | | | |
|---|---|---|---|
| 0065064 | 11/1982 | European Pat. Off. | 132/184.61 |
| 2214373 | 10/1973 | Germany | 123/184.61 |
| 2744039 | 4/1979 | Germany | 123/184.21 |
| 2132692 | 7/1984 | United Kingdom | 123/184.42 |

*Primary Examiner*—David A. Okonsky
*Attorney, Agent, or Firm*—Harness, Dickey & Pierce, P.L.C.

[57] ABSTRACT

An air intake manifold for use with an internal combustion engine is provided with a labyrinth configuration in order to reduce the amount of space consumed by the manifold. The manifold is preferably made from a plastic material for reducing the weight of the manifold and for providing an inexpensive and relatively simple molding process.

30 Claims, 6 Drawing Sheets

LABYRINTH MANIFOLD

FIELD OF THE INVENTION

The invention relates to a tuned air intake manifold for use with an internal combustion engine, and more particularly, to a labyrinth-type manifold which incorporates the functions of a plenum, attachment flange, and runners into a molded box with inner walls for defining serpentine or curved shaped runners within the box.

BACKGROUND AND SUMMARY OF THE INVENTION

The air intake manifold of a multi-cylinder engine is a branched pipe arrangement which connects the valve ports of each cylinder with the air inlet. In a carbureted engine, it would be connected between the valve ports and the carburetor, which would be downstream of the air inlet. The manifold can have considerable effect on engine performance. The intermittent or pulsating nature of the air flow through the manifold into each cylinder may develop resonances (similar to the vibrations in organ pipes) in the air flow at certain speeds. These may increase the volumetric efficiency and thus the power at certain engine speeds, but may reduce such efficiency at other speeds, depending on manifold dimensions and shape. Therefore, each manifold passageway is ideally tuned to a length calculated to maximize or minimize a chosen criteria, such as sound or efficiency.

Conventional manifolds can usually be broken into three distinct parts, the plenum, the runners (fluid conduits or pipes), and an attachment portion having an engine-attaching surface. For conventional plastic manifolds, there are two processes currently accepted as production methods, the fusible core process and the multi-shell, welded process. The fusible core process is capital intensive and difficult to keep in operation. The multi-shell welded manifold process produces relatively large parts which waste significant underhood room. With ever-decreasing available underhood packaging room, the problem of fitting a manifold to an engine becomes a greater challenge.

Accordingly, it is desirable in the art of engine manifolds to provide a tuned manifold which has smaller packaging requirements and which is easy to manufacture.

The present invention incorporates the function of a plenum, attachment flange, and tuned runners into a simply molded box with interior walls in order to save significant cost and underhood room.

The present invention also provides a manifold system which is easier to manufacture than many currently used manifolds.

The present invention further provides a manifold assembly which has smaller packaging requirements and which is simple in structure, easy to mass produce, durable in use, and refined in appearance.

The present invention provides an air intake manifold for use with an internal combustion engine having a labyrinth runner configuration in order to reduce the amount of space consumed by the manifold. The manifold is preferably made from a plastic material for reducing the weight of the manifold and for providing fabrication by an inexpensive and relatively simple molding process.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description. For example, while the manifold of the present invention is extremely useful for use as an intake manifold for an internal combustion engine, it may find utility as a manifold for use with compressors, pumps and other apparatus.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
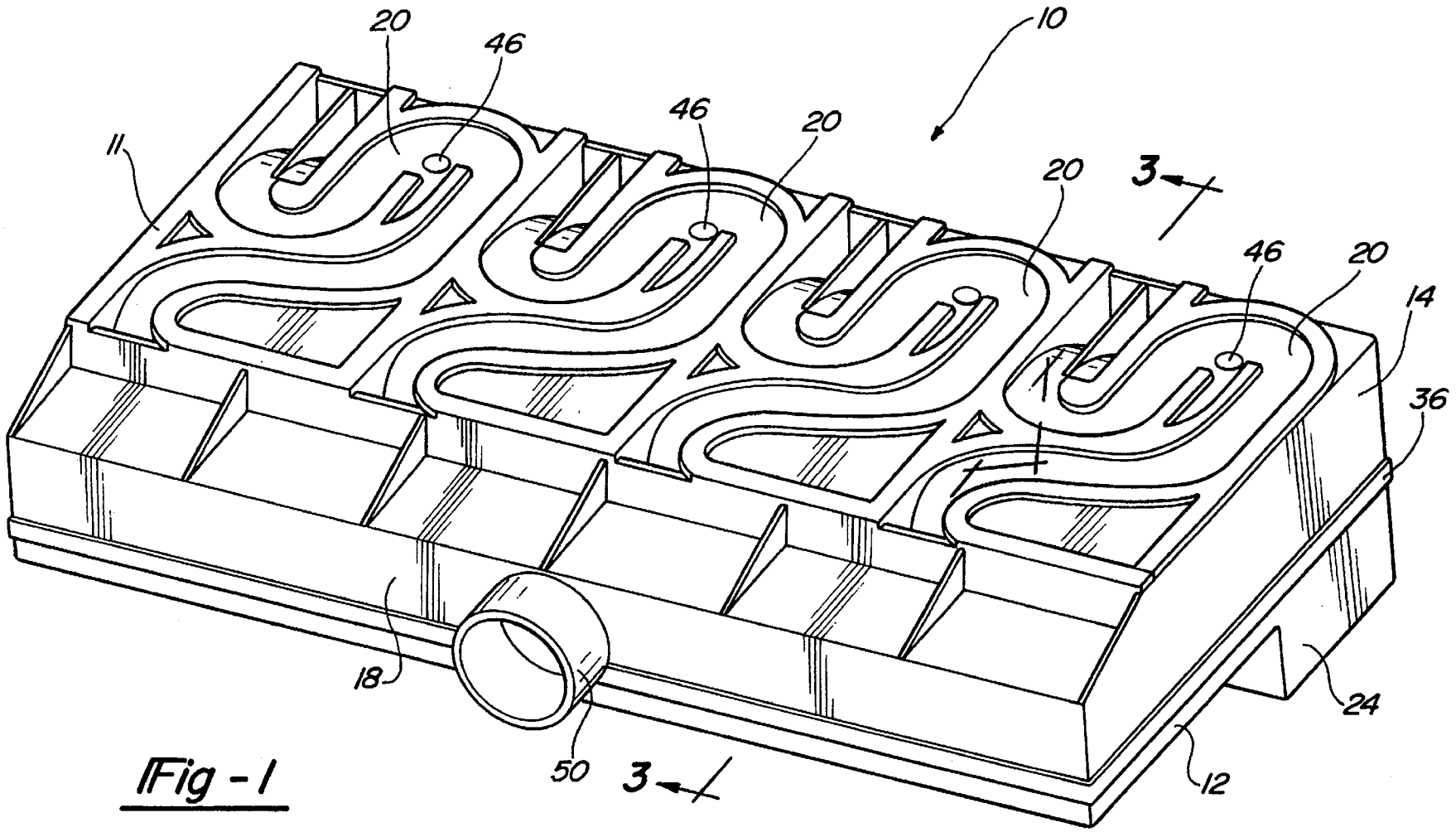
FIG. 1 is a perspective view of a labyrinth manifold according to the principles of the present invention.
Figure 2:
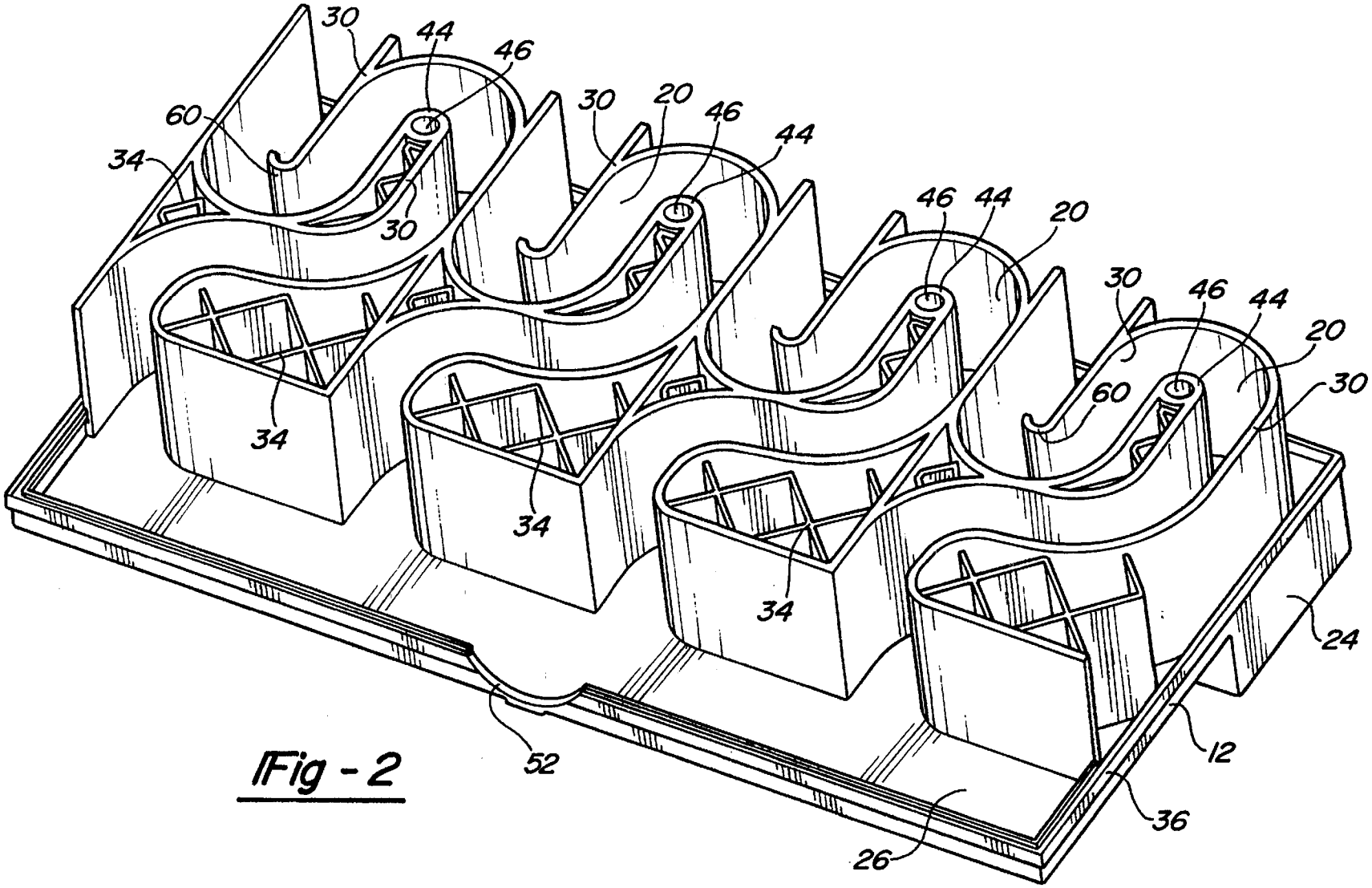
FIG. 2 is a perspective view of the labyrinth box member of the labyrinth manifold showing the inner walls defining the runners.
Figure 3:
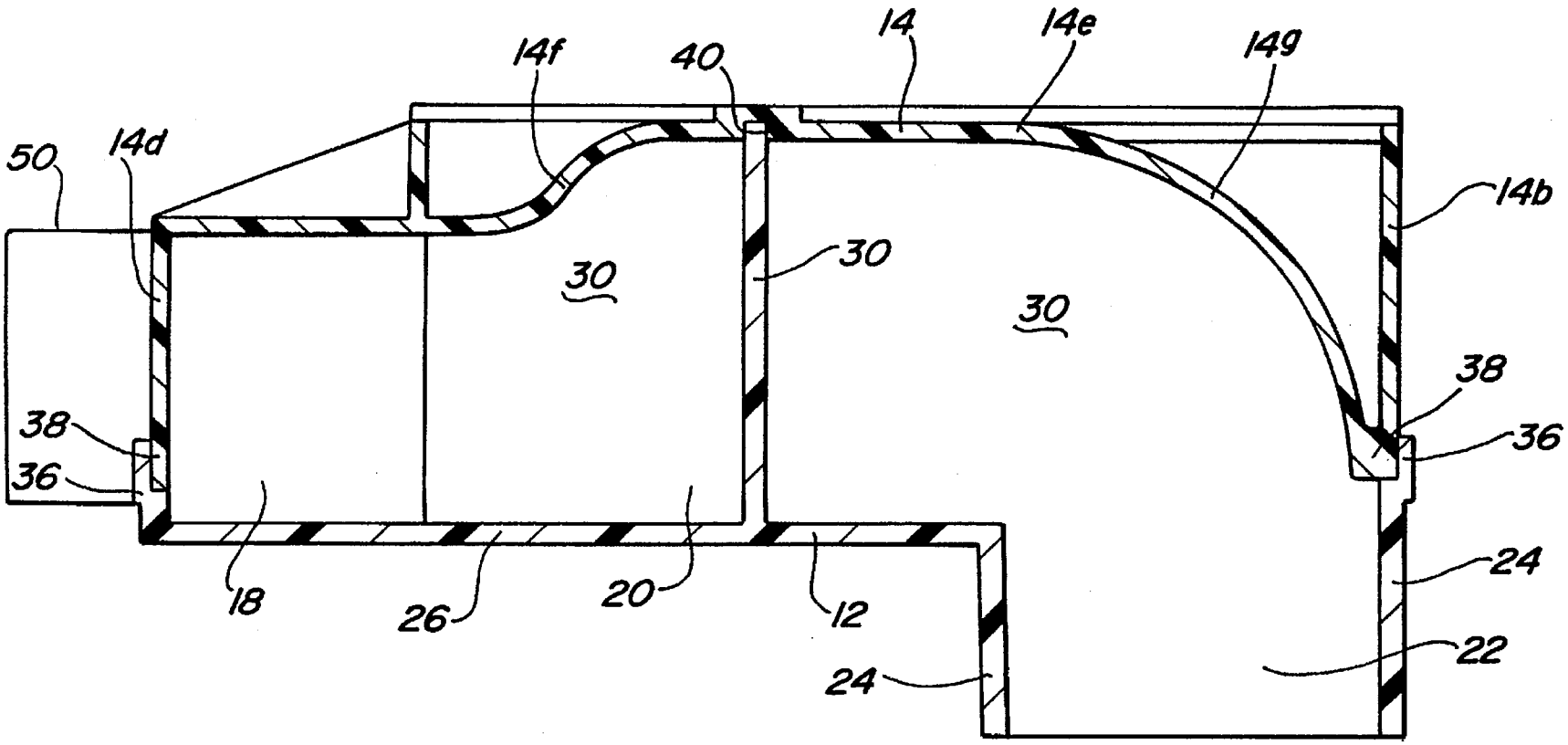
FIG. 3 is a transverse sectional view taken along line 3—3 in FIG. 1.
Figure 4:
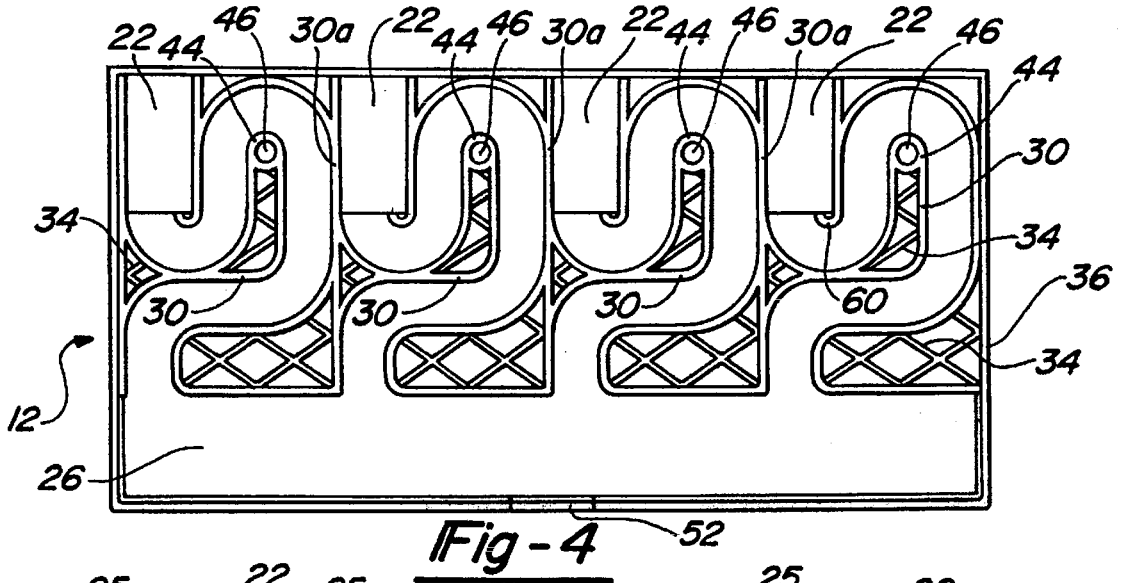
FIG. 4 is a plan view of the labyrinth box member showing the inner walls forming the runners.
Figure 5:
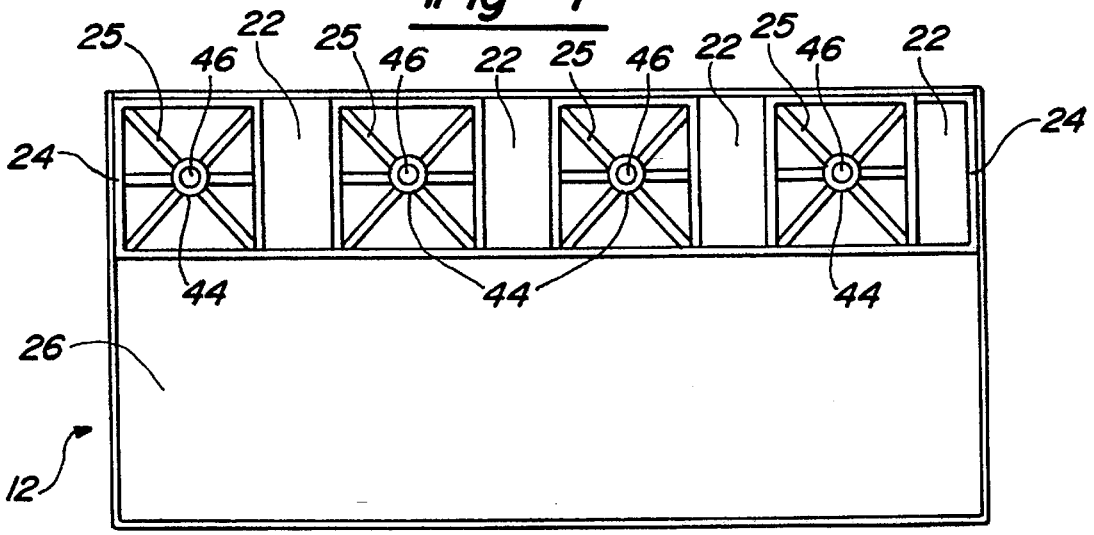
FIG. 5 is a plan view of the engine attaching surface of the labyrinth box member of the labyrinth manifold.

With reference to FIGS. 1–6, a first embodiment of the present invention will be described. As shown, labyrinth manifold 10 includes a housing 11 including a first housing member and a second housing member. The first and second housing members include a molded labyrinth box member 12 and a cover member 14 assembled on labyrinth box member 12. Labyrinth box member 12 and cover member 14 combine to define a plenum chamber 18 and a plurality of runners 20. Runners 20 communicate between plenum chamber 18 and outlet ports 22 communicating with an engine attachment flange 24, as best shown in FIGS. 4 and 5. Engine attachment flange 24 is shown disposed on a back side of box member 12, however, if desired, it may be disposed at other locations such as on the outer surface of cover member 14, for example. As shown in FIG. 5, engine attachment flange 24 is preferably provided with a plurality of reinforcing ribs 25.

Labyrinth box member 12 is provided with a generally planar base portion 26. A plurality of integral inner walls 30 extend from a base portion 26 for defining the side walls of runners 20. Inner walls 30 are planar and generally perpendicular to base portion 26. However, it should be understood that inner walls 30 may also be angled with respect to the base portion 26. As best seen in FIG. 4, inner walls 30 are provided with common wall portions **30*a* which are disposed between two adjacent runners 20. The interface between inner walls 30 and base portion 26 can also be radiused in order to reduce turbulence in the air flow through runners 20**.

Runners 20 are generally labyrinth shaped. By "labyrinth shaped", it is meant that the runners 20 are substantially serpentine or otherwise curved in shape in plan. The length of the runners 20 is tuned to the engine's power and fuel efficiency as is known in the art with regard to conventional manifolds. Thus, if long runners are required in order to obtain a desired engine power or fuel efficiency, each runner can be folded into a serpentine shape in order to provide a desired runner length between its plenum outlet portion 20*a* and its outlet port 22 so as to occupy a compact space. Shorter runners will require less curvature. Inner walls 30 may also be provided with reinforcement ribs 34 for providing strength. A flange 36 is provided around an outer periphery of base portion 26 to facilitate attachment of labyrinth box member 12 to cover member 14.

Cover member 14 is generally provided with a plurality of sidewalls 14*a*–14*d* and a top wall 14*e*. Sidewalls 14*a*–14*d* are each provided with a peripheral flange 38 which engages flange 36 of labyrinth box member 12. Flange 36 is designed to overlap with flange 38, as shown in FIG. 3, in order to provide a sealing relationship between box member 12 and cover member 14. Top wall 14*e* is provided with an upwardly curved portion 14*f* adjacent to plenum chamber 18 for allowing a smooth air flow from plenum chamber 18 into runners 20. Top wall 14*e* is also provided with a downwardly curved portion 14*g* above outlet ports 22 of labyrinth box member 12.

Figure 6:
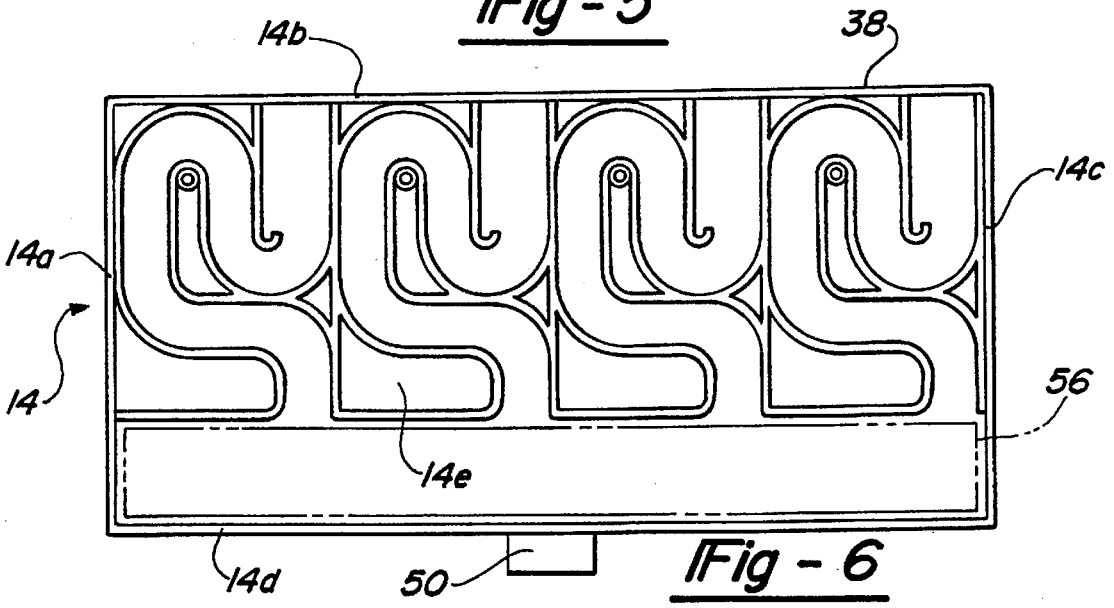
FIG. 6 is a plan view of the bottom of the cover member of the labyrinth manifold.

As best shown in FIG. 6, the top wall 14*e* of cover member 14 is provided with a plurality of grooves 40 which correspond to the configuration of inner walls 30 of box member 12. Grooves 40 are designed to engage with the upper edges of inner walls 30, as shown in FIG. 3. An adhesive seal bead is preferably provided between the grooves 40 and inner walls 30 to ensure air tightness between each of the runners 20 such that no "crosstalk" between runners occurs. In addition, an adhesive seal bead is provided between flange 36 and flange 38 in order to secure cover member 14 to labyrinth box member 12. Cover member 14 may also be fastened to box member 12 by bolts, screws, or other known fastening methods (not shown).

Labyrinth box member 12 and cover member 14 are preferably made from an engineering plastic material having suitable performance properties such as desirable heat stability and dimensional stability and utilizing a conventional injection molding technique. Illustrative materials are nylon (polyamide), ABS polymer (acrylonitrile-butadiene-styrene), and polycarbonate. Such materials may also be reinforced with glass and/or mineral fibers or particles. Especially preferred materials are ULTRAMID® A3HG7 Blk Q17 20560 nylon, ULTRAMID® A3WG7 Blk 23210 nylon, and ULTRAMID® B3WG7 Blk 564 BGVW nylon, commercially from BASF Corporation of Wyandotte, Mich. The use of such materials provides a weight reduction in comparison with steel and aluminum manifolds which are currently in use. However, the labyrinth manifold 10 may also be made from steel, aluminum, or other suitable materials without sacrificing the smaller packaging obtained by the design of the present invention. When a glass-reinforced nylon or other engineering plastic material is used, the box member 12 and cover member 14 can be formed by known injection molding processes.

The adhesive sealant which is used for securing cover member 14 to box member 12 can be any known suitable adhesive sealant, such as room temperature vulcanizing (RTV) silicone sealant.

Box member 12 and cover member 14 are each provided with bosses 44 around bolt holes 46. The bosses 44 on the box member 12 align with bosses 44 on cover member 14. A plurality of bolts (not shown) are inserted through bolt holes 46 of box member 12 and cover member 14 in order to secure engine attachment flange 24 of labyrinth manifold 10 to the engine (not shown), with outlet ports 22 in alignment with the intake valve ports of the engine (a four cylinder engine in the embodiment shown).

Cover member 14 is provided with an integral tubular flange 50 which is connected to the carburetor or throttle body of the air intake system, not shown. Tubular flange 50 is received in a cut out portion 52 of labyrinth box member 12. Alternatively, the tubular flange 50 can be molded with labyrinth box member 12 or may be partially molded in both the box member 12 and cover member 14, as will be clear to the skilled artisan in light of the instant teachings.

Labyrinth manifold 10 can be provided with internal valving or baffles as desired, as utilized in conventional manifolds, for partitioning the runners to increase or decrease the runner volume under certain circumstances. In particular, depending upon the engine RPM, different runner lengths are needed for optimal engine performance. Thus, valving is used in order to attempt to optimize the engine performance at more than one engine speed. Runners 20 can also be originally formed with different lengths for each outlet port, if desired.

The labyrinth manifold 10 may optionally be designed to receive a filter 56 in plenum chamber 18, as shown in phantom lines in FIG. 6. Additionally, it is possible to provide labyrinth manifold 10 with a noise shield. A noise shield would be obtained by providing hollow sections in the outer surfaces of labyrinth box member 12 or cover member 14. The hollow sections could then be filled with foam or other noise absorbing materials. The internal valving, air filter, and other noise absorbing materials can be inserted into the manifold 10 before final assembly.

Furthermore, if additional runner length is required for optimal engine performance, it is also possible to stack another labyrinth box on top of labyrinth box member 12 in order to increase the length of the runners 20. In this case, the inner walls would define runners which communicate between the stacked labyrinth box members so that the runner length can be increased, as will be clear to the skilled artisan in light of the instant teachings.

The shape of runners 20 is such as to ensure adequate airflow around the corners of the runners without significant pressure loss. Flow losses can be further reduced by increasing the height of the runners 20 either locally or throughout their full length to increase the cross section thereof. Downstream edges can also be folded back, as at 60, to enhance efficient air flow.

Figure 7:
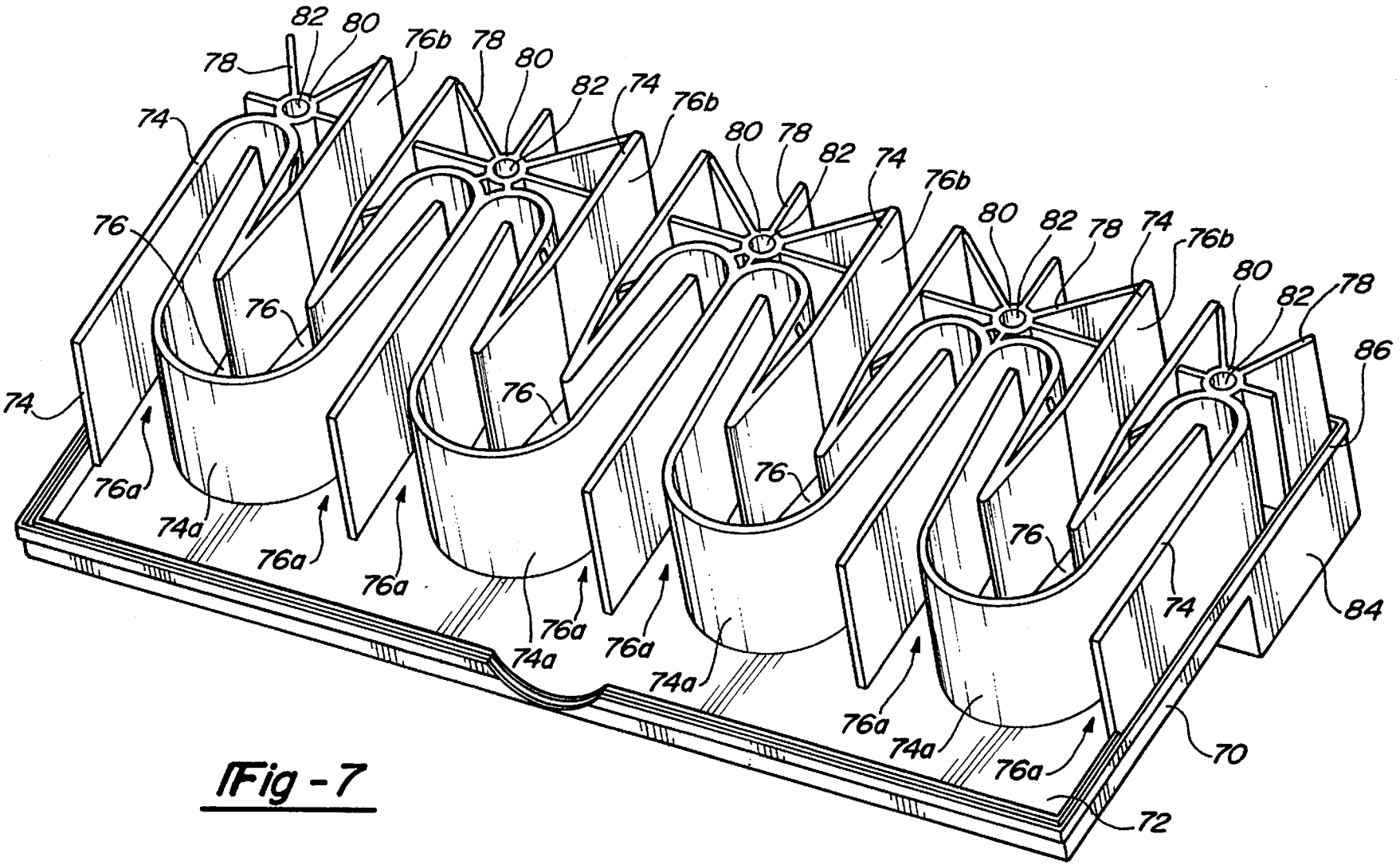
FIG. 7 is a perspective view of a second embodiment of the labyrinth box member according to the principles of the present invention.

FIG. 7 illustrates a labyrinth box member 70 according to an alternative embodiment of the present invention. Labyrinth box member 70 is provided with a base portion 72 having inner walls 74 extending therefrom for defining a plurality of runners 76. Runners 76 include a pair of split inlet runner portions 76*a* and a common outlet runner portion 76*b*. Split runner portions 76*a* are defined by U-shaped inner walls 74*a*. Thus, a pair of split runners 76*a* communicate with the common runner portion 76*b* which has an outlet (not shown) disposed at an end thereof. Reinforcing members 78 are provided for supporting inner walls 74, and boss members 80 are provided with mounting bolt holes 82 therethrough. Attachment flange 84 is provided for attaching the labyrinth manifold to the intake ports of an engine. Under this embodiment a cover member (not shown) would be provided with outside walls and grooves for engaging the top edges of the inner wails and bosses in a similar manner as discussed above with respect to FIGS. 1–6.

Figure 8:
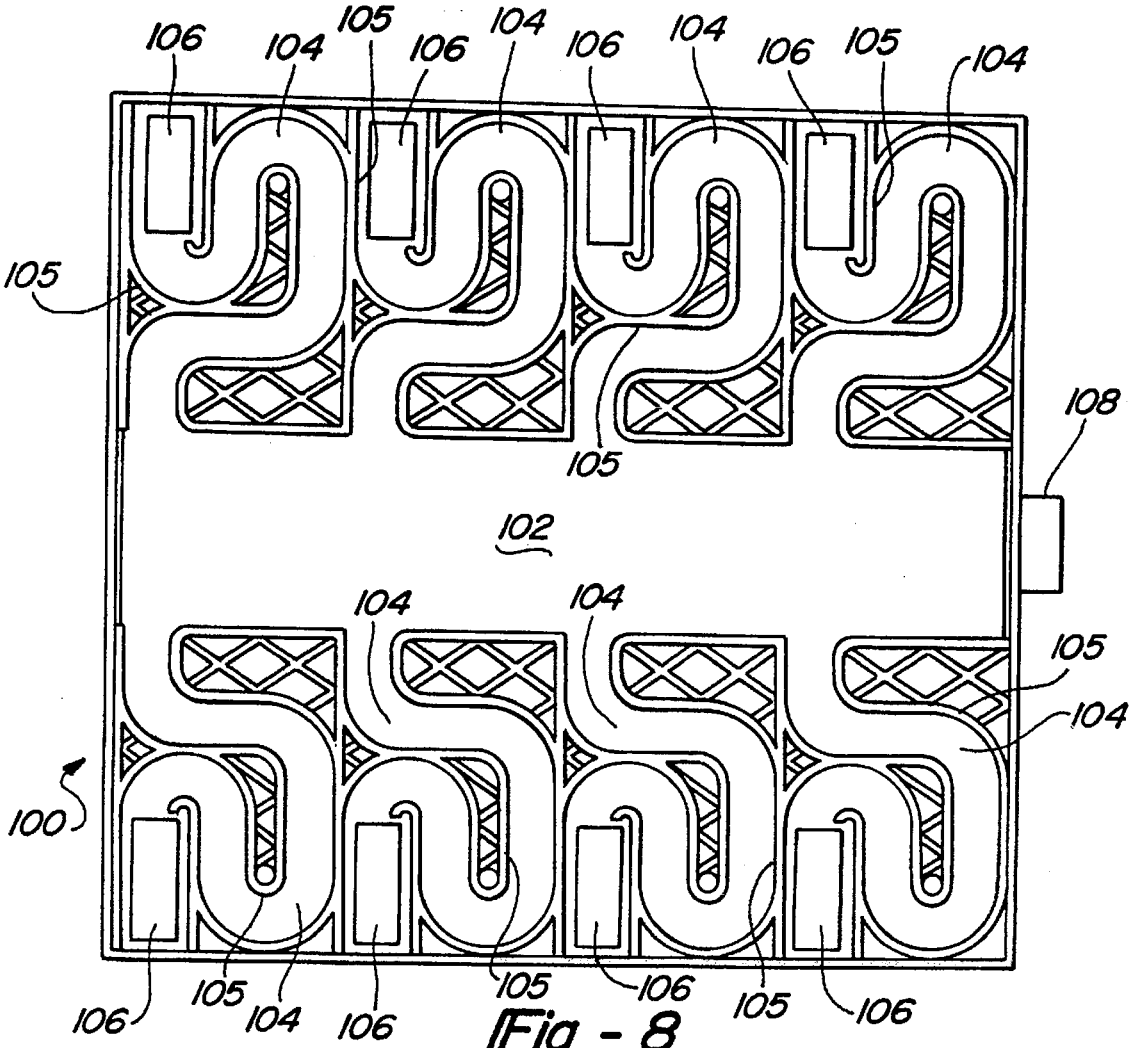
FIG. 8 is a plan view of a third embodiment of the labyrinth box member according to the principles of the present invention for use with a V-type engine.
Figure 9:
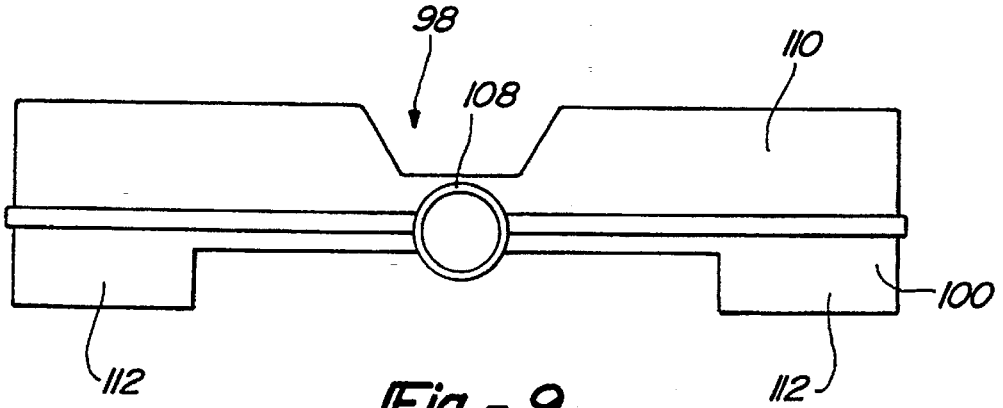
FIG. 9 is an end view of a labyrinth manifold for a use with a V-type engine.

The labyrinth manifold design according to the present invention can also be used with a V-type engine design. In particular, with reference to FIGS. 8 and 9, a labyrinth manifold 98 for use with a V-type engine would include labyrinth box member 100 and a cover member 110, shown in FIG. 9, for defining a centrally located plenum chamber 102 having serpentine or curved runners 104, defined by walls 105, disposed on each side thereof for communicating with outlet ports 106 which are connected with the valve ports of the cylinders on each bank of a V-type engine. A tubular flange 108 opens into plenum 102. An attachment flange 112 is provided for attaching the labyrinth manifold 98 to the intake ports of an engine. If preferred, the outlet ports could be located in the end wall of each of the runners.

In each of the labyrinth manifold designs discussed above, the length of each runner is tuned to a desired value in accordance with standard criteria based upon the engine parameters and desired performance characteristics. This value is usually calculated and specified to the manifold manufacturer by the engine designer. It should be understood that the present invention provides great flexibility for providing various lengths of runners without sacrificing the smaller packaging which is desired in automobile manufacturing. Furthermore, it is possible to easily incorporate other features such as valving, filters, and the like. It is also possible to mold-in a noise shield for noise reduction. The present invention may also be used for V-type engines.

The invention being thus described, it should be recognized by those skilled in the art that the same may be varied in many ways. Such variations are not to be regarded as a departure from the spirit and scope of the invention, and all such modifications are intended to be included within the scope of the following claims. For example, the runners of the labyrinth manifold have been defined as being labyrinth shaped, however, if short runners are needed for a specific application, the manifold design of the present invention can be used with straight runners while still obtaining the benefits of an easily moldable compact manifold assembly.

What is claimed is:

1. A manifold comprising:

a housing including a first housing member and a second housing member adapted to be connected to said first housing member, said housing defining a plenum chamber and a plurality of labyrinth shaped runners;

wherein said first housing member is provided with a plurality of inner walls extending from a base thereof for defining sidewalls of said labyrinth shaped runners.

2. The manifold according to claim 1, wherein said housing is made from a plastic material.

3. The manifold according to claim 1, wherein said labyrinth shaped runners are serpentine shaped.

4. The manifold according to claim 1, wherein said inner walls of said first housing member are generally perpendicular to said base portion and said second housing member is provided with grooves corresponding to said inner walls for engaging with said inner walls.

5. The manifold according to claim 1, wherein one of said first and second housing members includes a plurality of outlet passages associated with said plurality of labyrinth shaped runners.

6. The manifold according to claim 5, wherein one of said first and second housing members includes a plurality of downwardly curved portions which are provided opposite said outlet passages.

7. A manifold comprising:

a housing including a first housing member and a second housing member adapted to be connected to said first housing member, said housing defining a plenum chamber and a plurality of runners;

wherein said first housing member is provided with a plurality of inner walls extending generally perpendicularly from a base thereof for defining sidewalls of said runners and said second housing member having a plurality of grooves corresponding to said inner walls for engaging therewith.

8. The manifold according to claim 7, wherein one of said first and second housing members include a plurality of outlet ports associated with said plurality of runners.

9. The manifold according to claim 8, wherein one of said first and second housing members includes a plurality of downwardly curved portions which are provided opposite said outlet ports.

10. The manifold according to claim 7, wherein said housing is made from plastic material.

11. The manifold according to claim 10, wherein said plastic material is a glass reinforced nylon material.

12. The manifold according to claim 7, wherein one of said first and second housing members is provided with an inner flange around a periphery of a surface thereof and the other of said first and second housing members is provided with an outer flange around a periphery thereof for engaging said inner flange.

13. The manifold according to claim 7, wherein said first and second housing members are each provided with a plurality of bosses having a bolt hole for securely fastening said housing to said internal combustion engine, said bosses of said first housing member having a corresponding boss on said second housing member which are aligned with one another for receiving a bolt therethrough.

14. The manifold according to claim 7, wherein a sealant is applied to said grooves such that an effective seal is obtained between the first and second housing members.

15. The manifold according to claim 7, wherein said plurality of runners are labyrinth shaped.

16. The manifold according to claim 7, wherein said inner walls include common wall portions which are disposed between two adjacent runners.

17. A manifold comprising:

first housing member and a second housing member connected together to define a housing having a generally rectangular box structure, said housing defining a plenum chamber and a plurality of runners communicating with said plenum chamber;

wherein said first housing member is provided with a plurality of inner walls extending from a base thereof for defining sidewalls of said runners and said second housing member engaging with an upper surface of said inner walls.

18. The manifold according to claim 17, wherein one of said first and second housing members include a plurality of outlet passages associated with said plurality of runners.

19. The manifold according to claim 17, wherein one of said first and second housing members includes a plurality of downwardly curved portions which are provided opposite said outlet passages.

20. The manifold according to claim 17, wherein said housing is made from plastic material.

21. The manifold according to claim 20, wherein said plastic material is a glass reinforced nylon material.

22. The manifold according to claim 17, wherein one of said first and second housing members is provided with an inner flange around a periphery of a surface thereof and the other of said first and second housing members is provided with an outer flange around a periphery thereof for engaging said inner flange.

23. The manifold according to claim 17, wherein said first and second housing members are each provided with a plurality of bosses having a bolt hole for securely fastening said housing to said internal combustion engine, said bosses of said first housing member each corresponding with a boss on said second housing member which are aligned with one another for receiving a bolt therethrough.

24. The manifold according to claim 17, wherein said inner walls include common wall portions disposed between two adjacent runners.

25. The manifold according to claim 17, further comprising a filter disposed between said first and second housing members.

26. The manifold according to claim 17, wherein said plurality of runners are labyrinth shaped.

27. A method of making a manifold, comprising the steps of:

injection molding a first housing member from an engineering plastic material, said first housing member having a plurality of planar walls extending from a generally flat base thereof;

injection molding a second housing member from a plastic material; and fastening said second housing member to said first housing member, wherein said second housing member engages a top portion of said plurality of walls for defining a plurality of runners.

28. The method according to claim 27, wherein said step of fastening said second housing member to said first housing member includes using an adhesive between said first and second housing members.

29. The method according to claim 27, wherein said plurality of runners and labyrinth shaped.

30. The method according to claim 27, wherein said first and second housing members are made from glass reinforced nylon.

* * * * *